US005608972A

United States Patent [19]

Tsae-Chyn

[11] Patent Number: 5,608,972

[45] Date of Patent: Mar. 11, 1997

[54] STRETCHING AND CONTRACTING RAZOR CASE

[76] Inventor: Chern Tsae-Chyn, No. 21, Lane 82, Alley 422, Min-Tzwu Rd., Lu Jou Hsiang, Taipei Hsien, Taiwan

[21] Appl. No.: 562,380

[22] Filed: Nov. 24, 1995

[51] Int. Cl.[6] ..... B26B 21/52

[52] U.S. Cl. ..... 30/526; 30/32

[58] Field of Search ..... 30/32, 85–89

[56] References Cited

U.S. PATENT DOCUMENTS

| | | | |
|---|---|---|---|
| 1,176,780 | 3/1916 | Roth | 30/85 |
| 1,749,051 | 3/1930 | Watt | 30/85 |

FOREIGN PATENT DOCUMENTS

| | | | |
|---|---|---|---|
| 463265 | 3/1937 | United Kingdom | 30/85 |
| 504388 | 4/1937 | United Kingdom | 30/85 |

*Primary Examiner*—Douglas D. Watts
*Attorney, Agent, or Firm*—Morton J. Rosenberg; David I. Klein

[57] ABSTRACT

A razor having a retractable shaving head is provided. The retractable shaving head razor includes a main body having generally a "T" shape that carries a conventional razor blade cartridge and which is displaceably housed within a shell having generally a shape that corresponds to the "T" shape of the main body. The shell is characterized by a "T" shaped cavity formed therein within which the main body may be stowed. Interfacing the main body and the shell is a positioning mechanism formed by a compression member which spring biases the main body relative to the shell and a locking plate pivotally coupled to the main body which is rotated by deflection to appropriately lock the main body in a shaving or a stowed position relative to the shell. The main body may be displaced between its shaving and stowed positions simply by applying a temporary depression force thereon. The locking function of the locking plate is automatically effected by this depression force and the resulting displacement of the main body relative to the shell.

2 Claims, 4 Drawing Sheets

STRETCHING AND CONTRACTING RAZOR CASE

FIELD OF THE INVENTION

The present invention relates to a shaving razor. More specifically, the present invention relates to a shaving razor having a retractable shaving head which is easy to carry and which protects the shaving head from contamination.

BACKGROUND OF THE INVENTION

Prior art shaving razors generally have a fixed configuration. Some may be stored in reusable storage cases, but most are not, except to the extent that they typically come packaged in plastic bags when initially purchased. Storage cases protect shaving razors during travel, but they typically are relatively bulky and cumbersome. Some users simply store shaving razors in the originally packaging bags during travel. While this may save space, such packaging bags are not adapted for repeated use. Often, the packaging bags are thrown out after opening, and the razor's shaving blade is exposed not only for damaging or dangerous contact, but for contamination by environmental elements.

OBJECTS OF THE INVENTION

It is the overall object of this invention to overcome the shortcomings that have been mentioned above. Accordingly, a shaving razor having a retractable shaving head which may be conveniently displaced between shaving and stowed positions is provided.

SUMMARY OF THE INVENTION

The subject retractable shaving head razor comprises a main body having a "T" shape which holds a razor cartridge and a shell which houses the main body. The shell has a shape that matches the "T" shape of the main body. Spring biasing and locking devices interfacing the main body to the shell enable the main body to be retractably displaced relative to the shell into its shaving position simply by pressing, then releasing the main body. The main body may be retracted into its stowed position after use by pressing it into the shell until it is locked therein.

DETAILED DESCRIPTION OF THE PREFERRED EMBODIMENT

Figure 1:
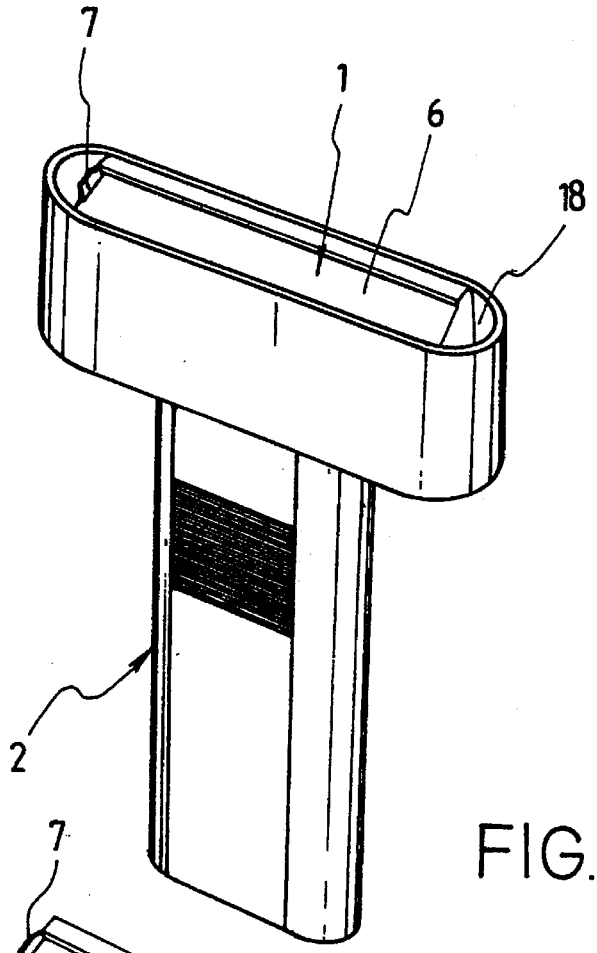
FIG. 1 is a perspective view of the preferred embodiment of the present invention in its stowed configuration.
Figure 2:
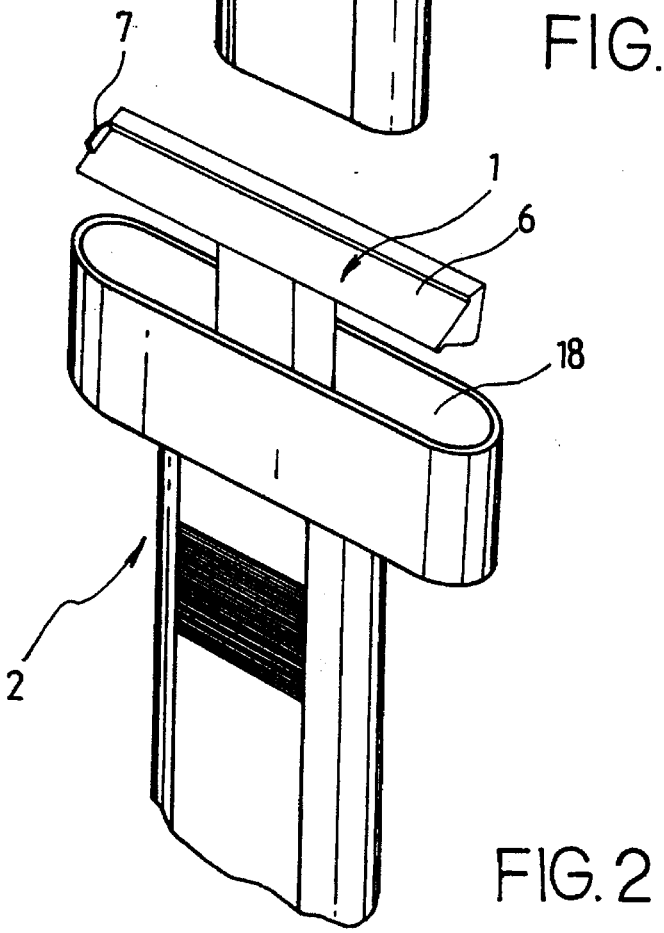
FIG. 2 is a perspective view of the preferred embodiment of the present invention in its shaving configuration.
Figure 3:
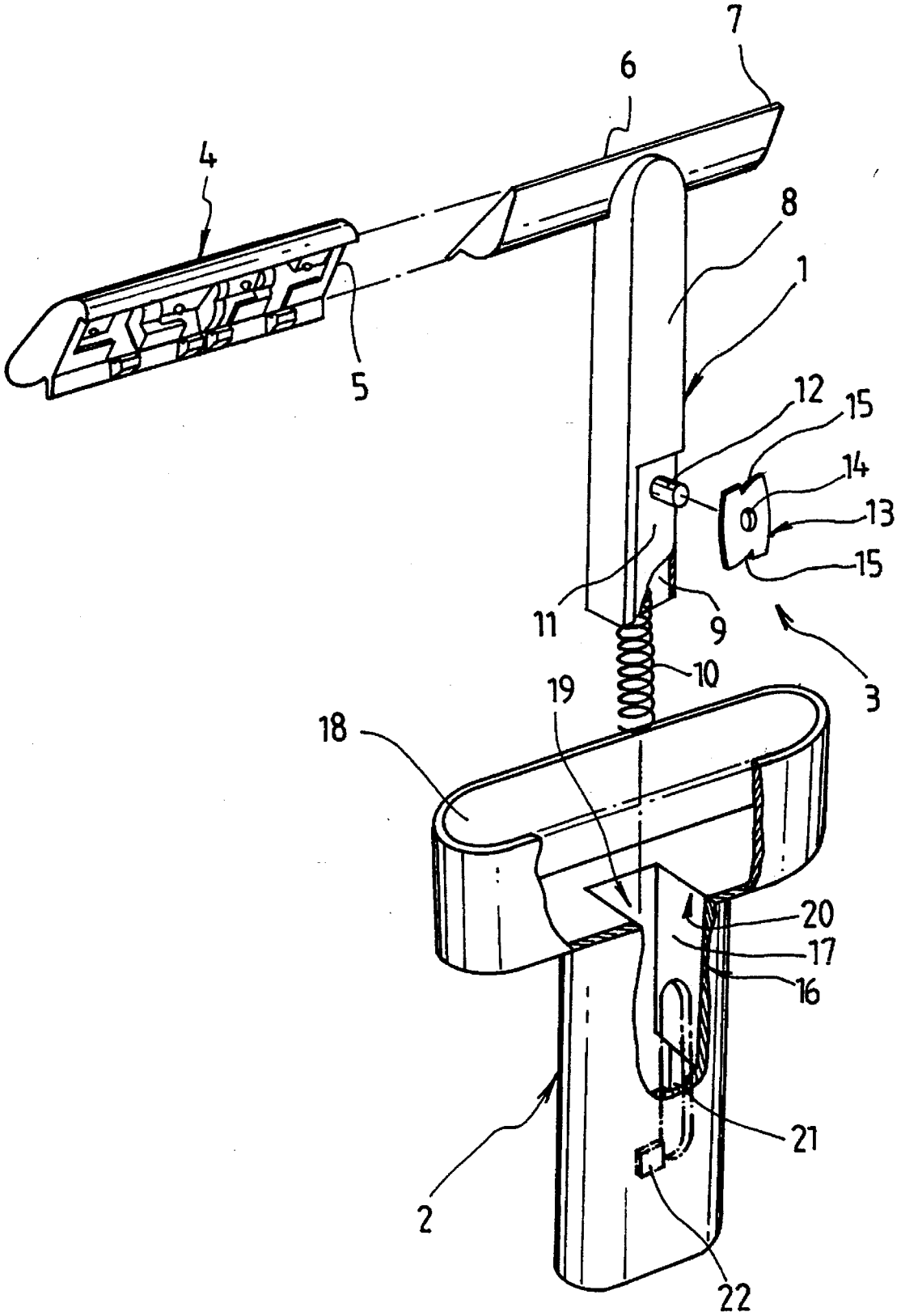
FIG. 3 is an exploded perspective view, partially cut-away, of the preferred embodiment of the present invention.

Referring to FIGS. 1 to 3, the present invention comprises a main body 1 on which a conventional blade cartridge 4 is fitted, a shell 2 for receiving and thereby housing the main body 1, and a positioning mechanism 3 for retracting and extending the main body 1 relative to the shell 2. The main body 1 has generally a "T" shape formed in part by a positioning block 7 for supporting and positioning the blade cartridge 4. A dovetail 6 that engages the dovetail groove 5 in the back of the blade cartridge 4 is disposed along the top of the main body 1, such that the blade cartridge may be secured thereto. Transversely extending from the center of the back of the positioning block 7 is a supporting rod 8 which may generally possess a rectangular or other suitable outer contour. At the free end of the supporting rod 8 is a hollow chamber 9 which receives compressed spring 10 of the positioning mechanism 3. On one side of the supporting rod 8 is formed a recess 11, and a pivot pin 12 is formed to project from that recess 11.

The positioning mechanism 3 includes a lock 13 having a rectangular, planar contour which is pivotally coupled to the pivot pin 12. A pivot hole 14 formed at the center of the lock 13 mates with the pivot pin 12. Onto opposed peripheral ends of the lock 13 are formed a pair of sections 15 separated by a smooth peripheral section. Each section 15 has a notched contour adapted to lock against the back of a protruding space 17 formed in a second wall 20 of the inner side of a vertical cavity 19 formed into the shell 2.

The shell 2 defines a generally "T" shaped cavity formed by transversely disposed horizontal and vertical cavities 18, 19. The dimensions of the vertical cavity 19 are such that it receives the supporting rod 8 of the main body 1 to thereby house supporting rod 8. A positioning slot 21 is formed through the side wall enclosing a portion of the vertical cavity 19. The pivot pin 12 passes through the pivot hole 14 of the lock 13 and engages the positioning groove 21 to be guided thereby during the vertical displacement of the main body 1 relative to the shell 22. This displacement is thus limited in range by the positioning groove 21. A protruding block 22 projecting laterally into the vertical cavity 19 is also formed on the vertical cavity-enclosing side wall. The block 22 and the protrusion 17 effect the rotation of the lock 13 when the smooth peripheral sections of the lock 13 engage them by causing the angular deflection thereof about the pivot pin 12.

Figure 4:
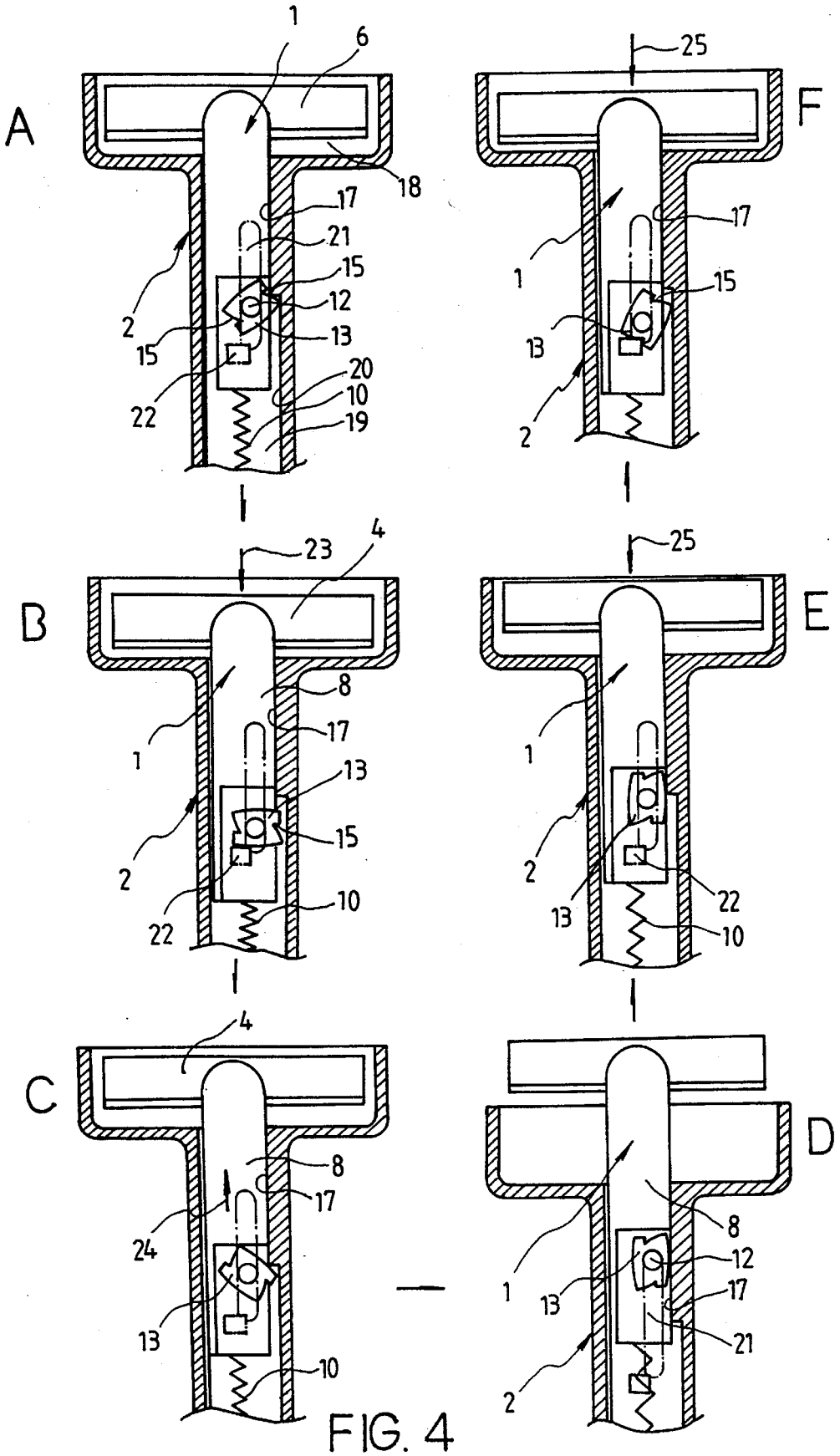
FIG. 4 is a series of cross-sectional views, partially cut-away, of the preferred embodiment of the present invention illustrating its operation during an extension-retraction sequence; and, FIG. 5 is a perspective view of the preferred embodiment of the present invention shown in its fully stowed and covered configuration.

Referring to FIGS. 3 and 4, the positioning mechanism 3 includes the compressed spring 10 captured in the hollow chamber 9 of the main body 1 by the base surface, or floor, of the vertical cavity 19. The positioning mechanism 3 also includes the lock 13 pivotally disposed in the recess 11 of the supporting rod 8 of the main body 1, which operatively interacts with the positioning slot 21, the protruding block 22, and the protrusion 17 of the shell 2.

A series of cross-sectional views illustrating in sequence the extension/retraction of the main body 1 relative to the shell 2 between its stowed and shaving positions is shown in FIG. 4. In FIG. 4A, a notched section 15 of the lock 13 locks against protrusion 17 on the side wall 20 of the shell 2. The main body 1 is fully stowed within the "T" shaped cavity of the shell 2. In FIG. 4B, when a depression force indicated by the arrow 23 is applied to the blade cartridge 4 on the main body 1, the main body 1 is moved towards the shell 2, causing the lock 13 on the supporting rod 8 to disengage from the end of the protrusion 17. As the downward movement is continued, a smooth peripheral segment of the lock 13 hits the protruding block 22. This angularly deflects the lock 13 into a horizontal orientation. In FIG. 4C, when the depression force is removed, the compression spring 10 pushes the supporting rod 8 in the upward direction as shown by the arrow 24. At that time, a smooth peripheral section of the horizontally oriented lock 13 hits the protrusion 17, causing the lock 13 to rotate and assume a vertical orientation. With the lock 13 so oriented, the supporting rod 8 of the main body 1 moves along the vertical cavity 19 until the pivot pin 12 is blocked by the upper end of the positioning slot 21. The main body is thus extended to its shaving position.

In FIG. 4E, after shaving is finished, application of a depression force on the main body 1, as shown by the arrow 25, causes the main body 1 to move downward into the shell 2 until the lock 13 and the protruding block 22 engage one another. This not only blocks further downward movement of the main body 1, it angularly deflects the lock 13 sufficiently to direct a notch segment 15 thereof towards the protrusion 17 (as FIG. 4F shows). When the depression force 25 is removed, the compressed spring 10 causes the main body 1 upward, and the notched segment 15 of the lock 13 to engage and lock against the end of the protrusion 17. The main body 1 is thus again stowed within the shell 2 (as FIG. 4A shows).

Figure 5:
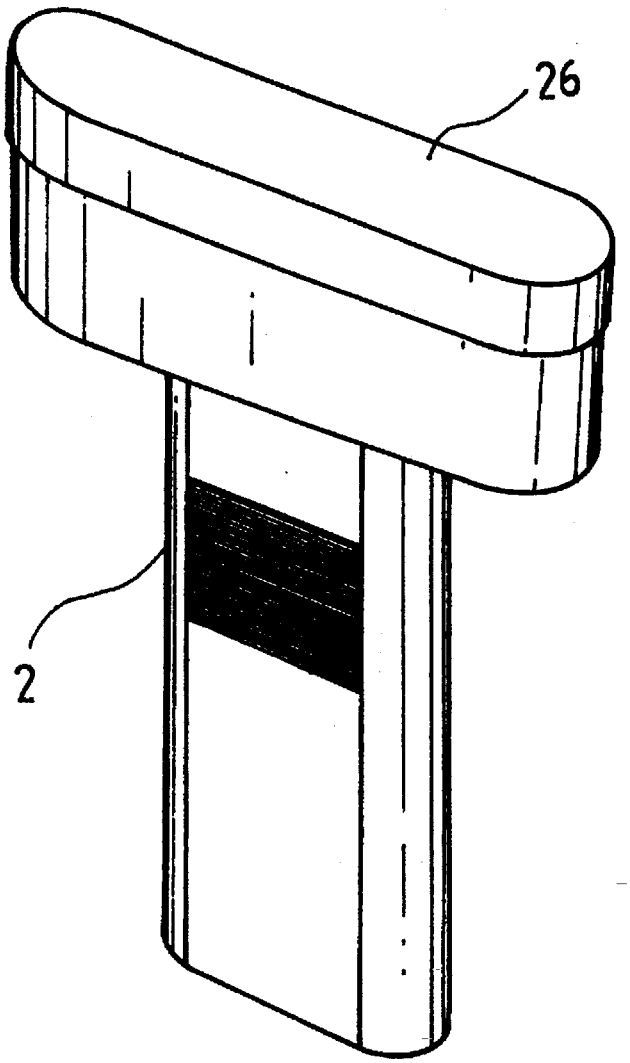

Referring now to FIG. 5, the open end of the shell 2 may be covered by a cover 26. This will protect the stowed main body 1 and its blade cartridge 4 from inadvertent contact and contamination by environmental elements.

I claim:

1. A retractable shaving head razor comprising:

(a) a main body member having a substantially T-shaped contour formed by a positioning block portion and a supporting rod portion, said positioning block portion being adapted to securely engage a razor blade cartridge, said supporting rod portion extending transversely from said positioning block portion along a longitudinal direction and terminating at a free end, said supporting rod portion having formed therein adjacent said free end a longitudinally extending hollow chamber, said supporting rod portion having formed on the outer surface thereof a recess and a pivot pin projecting from said recess;

(b) a shell member displaceably coupled to said main body member, said shell member having substantially a T-shaped contour and having formed therein transversely disposed horizontal and vertical cavities for respectively receiving therein said positioning block and supporting rod portions of said main body member, said vertical cavity being in open communication with said horizontal cavity, said shell member having a sidewall defining at least a portion of said vertical cavity, said sidewall having formed thereon first and second protrusions projecting into said vertical cavity and an elongate positioning slot, said positioning slot being engaged by said pivot pin of said supporting rod portion of said main body member;

(c) a compressible member received within said hollow chamber of said main body member supporting rod portion for maintaining said main body member in spring biased relation to said shell member; and, (d) a lock member pivotally coupled to said pivot pin of said main body member supporting rod portion, said lock member having formed respectively at each of a first pair of distal peripheral portions thereof a notched section and on each of a second pair of distal peripheral portions thereof a smooth section, each said notched section being adapted to limit the longitudinal displacement of said main body member in a first direction relative to said shell member upon engagement with said first protrusion of said shell member sidewall and to limit the axial displacement of said main body member in a second direction relative to said shell member upon engagement with said second protrusion of said shell member sidewall, each said smooth section being adapted for angular deflection about said pivot pin upon engagement with said first and second shell member sidewall protrusions;

whereby said main body member may be retractably displaced longitudinally relative to said shell member between a shaving position and a stowed position.

2. The retractable shaving head razor as recited in claim 1 including a cover member detachably coupled to said shell member, said cover member being adapted to cover said horizontal cavity of said shell member.

* * * * *